US006447191B1

(12) United States Patent
Vasas

(10) Patent No.: US 6,447,191 B1
(45) Date of Patent: Sep. 10, 2002

(54) FACIAL COSMETICS CONTAINER AND APPLICATOR

(75) Inventor: Martin M. Vasas, Fairfield, CT (US)

(73) Assignee: The Bridgeport Metal Goods Manufacturing Company, Stratford, CT (US)

( * ) Notice: Subject to any disclaimer, the term of this patent is extended or adjusted under 35 U.S.C. 154(b) by 0 days.

(21) Appl. No.: 09/667,166

(22) Filed: Sep. 21, 2000

Related U.S. Application Data

(60) Provisional application No. 60/156,076, filed on Sep. 24, 1999.

(51) Int. Cl.[7] ..... A45D 34/00; A45D 40/00; A45D 33/36

(52) U.S. Cl. ..... 401/7; 401/126; 401/127; 401/130; 401/191

(58) Field of Search ..... 401/5, 7, 126, 401/127, 130, 191

(56) References Cited

U.S. PATENT DOCUMENTS

| | | | | | |
|---|---|---|---|---|---|
| 1,070,598 | A | | 8/1913 | Guggenheim | |
| 1,534,259 | A | | 4/1925 | Dempsey | |
| 3,871,390 | A | * | 3/1975 | Spatz | 401/130 X |
| 4,752,147 | A | * | 6/1988 | Persi | 401/126 |
| 5,188,472 | A | | 2/1993 | Sgro | |
| 5,242,232 | A | | 9/1993 | Kuhn | |
| 5,492,426 | A | * | 2/1996 | Gueret | 401/126 |
| 5,573,340 | A | * | 11/1996 | Gueret | 401/126 |

* cited by examiner

*Primary Examiner*—Gregory Huson
*Assistant Examiner*—Kathleen J. Prunner
(74) *Attorney, Agent, or Firm*—Ware, Fressola, Van Der Sluys & Adolphson LLP

(57) ABSTRACT

A cosmetics container for storing and applying a product has a bottle having a neck defining a neck opening to an interior product cavity, the neck having threads on the exterior thereof. A neck insert is mounted in the neck opening, the neck insert including a side wall substantially conforming to the neck opening and providing access to the product cavity. The neck insert includes a dispenser wall deployed between the neck opening and the product cavity and the dispenser wall has at least one supply opening. A cap has interior threads for removably securing the cap on the bottle in a closed position by interengaging the threads on the neck. The cap having a stem extending into the neck insert and an applicator pad mounted to the distal end of the stem. The threads of the neck and the threads of the cap configured to support the cap on the neck prior to threaded engagement of the threads with the applicator pad spaced from the dispenser wall to define a dosing space therebetween. The applicator pad is fabricated of compressed foam and is compressed against the dispenser wall when the cap is threaded to its closed position on the bottle.

20 Claims, 5 Drawing Sheets

FACIAL COSMETICS CONTAINER AND APPLICATOR

RELATED APPLICATIONS

This application claims priority to U.S. provisional patent application serial No. 60/156,076, filed on Sep. 24, 1999.

FIELD OF THE INVENTION

The invention herein relates to a cosmetics container having an applicator cap for clean dispensing and application of the facial cosmetics.

BACKGROUND OF THE INVENTION

Facial cosmetics which include concealers, blushers, foundations, and therapeutic creams, such as for acne and skin rashes, may be similarly applied and are therefore included under the term "product" herein. They are typically creamy liquids, and can be of relatively high viscosity. Some of the cosmetics are pigmented and require shaking to place the pigment in suspension. These pigments also remain as the cream dries, and pigmented creams require extra care in storing and handling to avoid agglomeration of dried pigment.

Such facial products are traditionally provided in a bottle having a neck opening sized to be covered by a fingertip. After removing a cap from the bottle, the cosmetics are accessed by placing a finger over the neck opening and shaking the bottle. This both mixes the product and deposits it on the fingertip at the neck of the bottle. The fingertip is then used to apply the product to the user's face.

This method of dispensing product from the bottle and applying it to the face is somewhat messy, both to the fingers and hands of the user and at the neck of the bottle. One alternative is to provide a paddle extending from the cap, so that the paddle will carry product from the bottle. However, the paddle is ergonomically incorrect for applying the product to the face, and still requires use of a finger or a separate pad to spread the product on the face. Further, it can be difficult to reload the paddle in order to dispense additional product without securing the cap on the container.

Accordingly, there is a need for an efficient, comfortable and clean way of dispensing and applying facial cosmetics.

SUMMARY OF THE INVENTION

It is a principal object of the invention to provide a container having an applicator cap and applicator pad for facial cosmetics and other similar products.

It is an additional object of the invention to provide a container and applicator cap with applicator pad that is readily adaptable to product of varying viscosity.

It is a further object of the invention herein to provide a container and applicator cap with applicator pad for product that is comfortable and efficient to use.

It is another object of the invention to provide a container and applicator cap with applicator pad for product that controls dosing of the applicator pad and permits efficient redosing of the applicator pad.

It is a still further object of the invention to provide a container and applicator cap with applicator pad for product, and especially pigmented product, wherein the applicator pad is maintained in good condition between uses.

In carrying out the invention herein, there is provided a container generally comprising a bottle and an applicator cap. The bottle has a neck and a dispenser wall is disposed between the neck opening and a product cavity defined inside the bottle. The dispenser wall may be provided at the end of a neck insert. The dispenser wall has supply openings that control delivery of the product from the reservoir to the neck opening. The applicator cap has a handle portion including an interior wall configured for securing the cap over the neck of a bottle. A stem extends from the cap into the neck opening and neck insert, and an applicator pad is mounted on the stem for accumulating product dispensed through the supply openings. The cap is removed to expose the pad and product accumulated thereon for application, with the pad being manipulated by grasping the handle portion. The stem and pad mounted thereon may be reinserted in the neck opening to accumulate additional product. One of the pad and stem seals to the neck opening so that the bottle may be shaken to redose the applicator pad without leakage from the neck.

According to additional aspects of the invention, the supply openings in the dispenser wall are positioned to provide product to the applicator pad when the cap is placed on the neck of the bottle, but is spaced from its closed position. Also, according to this aspect of the invention, the applicator pad may be supported spaced from the dispenser wall for dosing, and may be positioned at the dispenser wall when the cap is secured in the closed position. Further, the applicator pad may be foam and may be compressed when the cap is secured in its closed position, limiting the amount of product on the pad during storage. The bottle neck is threaded and the cap is matingly threaded for attaching the cap to the bottle. The cap is spaced from its closed position by inference between the threads prior to screwing the cap to its closed position.

According to further aspects of the invention, the applicator pad is secured to the distal end of the stem. The pad is sized to engage the side wall of the neck insert as the stem is received therein. The pad may also extend along the stem and provide an interface between the stem and the side wall of the neck insert. Thus, the applicator pad substantially prevents product flow through the neck when the cap is not screwed to its closed position for dosing the pad.

According to other aspects of the invention, the distance of the applicator pad from the dispenser wall and the configuration and number of supply openings in the dispenser wall are varied to achieve the desired transfer of product to the applicator pad, with consideration of the viscosity and preferred amount of product. The supply openings may be a plurality of round openings, and also may be a plurality of slot openings as well as openings of various configurations.

Additional aspects of the invention include a finger space recessed into the cap to provide for comfortable manipulation of the cap, and an integral outer skirt of the cap to increase its thickness for comfortable manipulation and provide an outer shape complementary with the bottle.

Other objects and features of the invention will be readily understood by those skilled in the art with reference to the following description of preferred embodiments and their drawings.

BRIEF DESCRIPTION OF DRAWINGS

The same reference numerals refer to the same elements throughout various figures.

DESCRIPTION OF PREFERRED EMBODIMENTS

Figure 1:
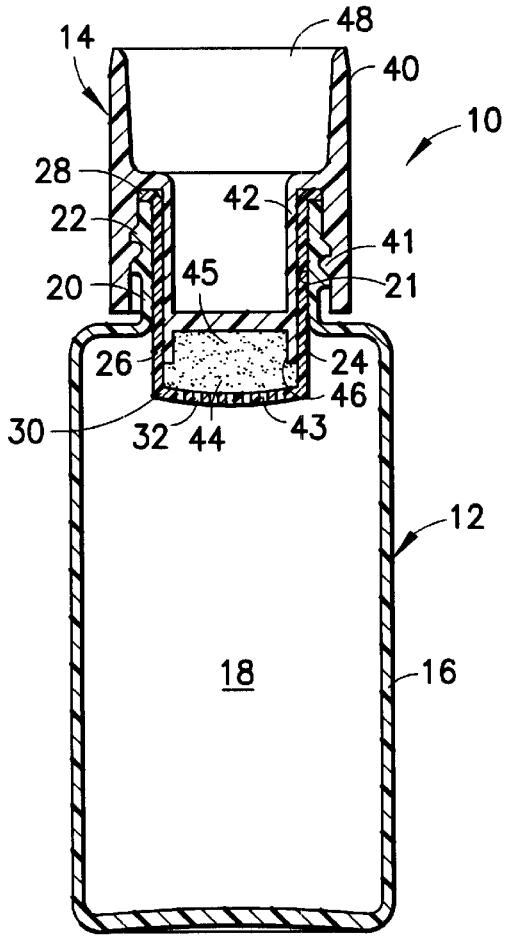
FIG. 1 is a longitudinal sectional view of a cosmetics container according to the invention herein.

A cosmetics container 10 according to the invention herein is shown in FIGS. 1–4. The cosmetics container 10 is adapted to apply creamy product, including concealers, blushers, foundation creams and therapeutic creams, as well as other makeups and creams of relatively high viscosity and which are suitable for application by an applicator pad.

The cosmetics container 10 generally comprises a bottle 12 and an applicator cap 14. The lower body portion 16 of the bottle 12 defines a product cavity 18 and the body portion 16 transitions to a tubular neck 20 of the bottle 12. The neck has exterior threads 22 formed thereon, providing means for engaging the cap 14, and the interior side walls of the neck define a neck opening 21 to the product cavity 18.

A cup-shaped neck insert 24 is mounted in the neck 20 and further defines the neck opening 21, with the tubular side wall 26 of the neck insert adjacent the tubular interior surface of the neck 20. A lip 28 supports the neck insert 24 on the neck 20. The neck insert 24 has a dispenser wall 30 deployed between the neck opening and the product cavity 18. The dispenser wall 30 is provided with a plurality of supply openings 32, which are best seen in the top view of the neck insert shown in FIG. 4. The supply openings consist of a plurality of circular supply openings 32. It will be appreciated the product passes from the product cavity 18 through the supply openings 32, and that the size, configuration and number of supply openings is selected for appropriate delivery of the product. The neck insert provides a convenient way of positioning a dispenser wall between the neck opening and the product cavity; however, the dispenser wall may be otherwise mounted or supported in such position.

The applicator cap 14 has a tubular handle 40 which is threaded at 41 on its lower interior surface, providing means to engage with the threads 22 on the bottle neck 20. A tubular stem 42 extends from the lower portion of the handle 40 and is received in the neck insert 24 of the bottle when the applicator cap is secured or partially secured thereon. An applicator pad 44 is mounted to the distal end of the stem 42. A recess 46 is provided at the end of the stem 42 for this purpose, and the pad has an integral mounting shank portion 45 secured in the recess. The pad 44 extends the entire diameter of the stem 42 and slightly beyond as required to engage in the side wall 26 of the neck insert.

The applicator pad 44 may be a latex pad, foam pad of various materials, fabric pad, flocked pad, or any applicator pad that is suitable for receiving, carrying and applying the product. The thickness and mounting of the pad may vary according to the material.

Figure 2:
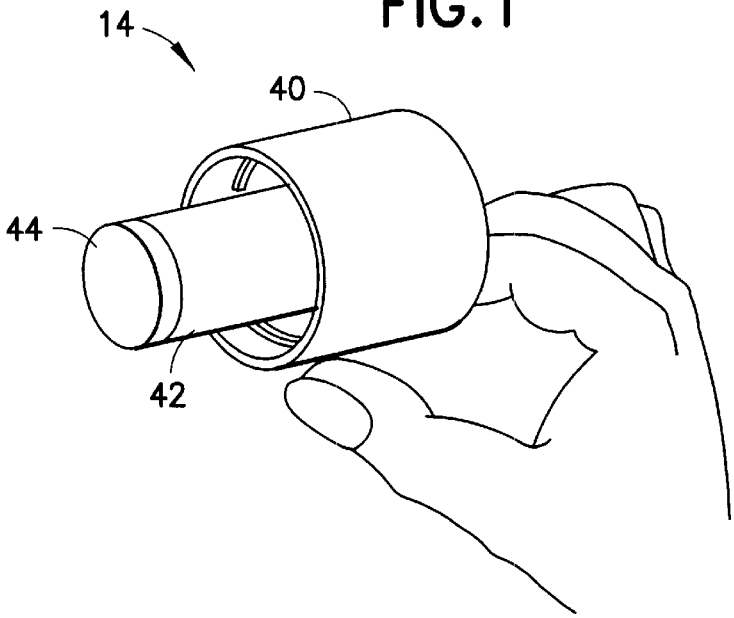
FIG. 2 is a perspective view of the applicator cap of the cosmetics container of FIG. 1, shown being manipulated for application of product.

The applicator cap 14 further defines a finger space generally indicated at 48, so that the applicator cap may be comfortably grasped and manipulated, as shown in FIG. 2.

With reference to FIG. 1, the end surface 43 of applicator pad 44 is positioned closely adjacent to or touching the dispenser wall 30 when the applicator cap is screwed down on the bottle 12. With the cap in this position, product is applied directly to the pad 44 through the supply openings. The cap is then removed, as shown in FIG. 2, and the product is applied via the pad 44 to the face or other skin area.

Figure 3:
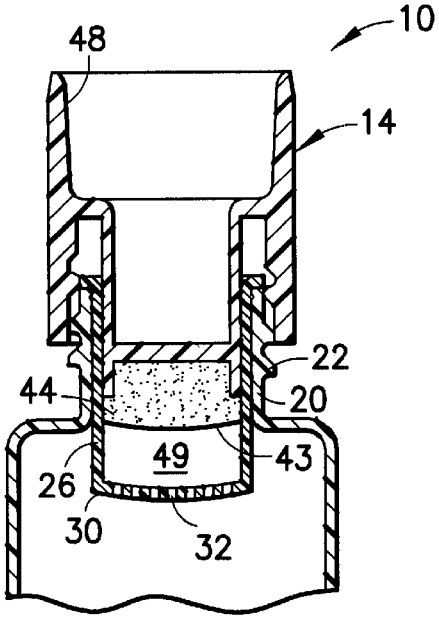
FIG. 3 is a longitudinal sectional view of the cosmetics container of FIG. 1, partially cut away, with the applicator cap inserted for receiving a dose of product.
Figure 4:
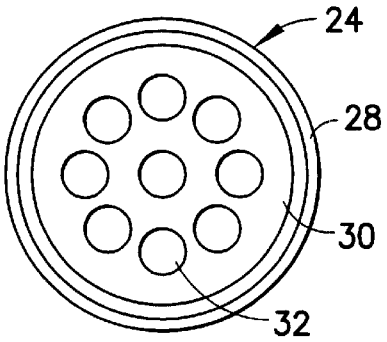
FIG. 4 is a top view of the neck insert of the cosmetics container of FIG. 1.

With reference to FIG. 3, the applicator pad 44 can be redosed with product by inserting the applicator cap on the neck 20 of the bottle, but without screwing the cap closed, so that the cap will be supported on the threads 22 of the neck. Thus, the end surface 43 of the applicator pad 44 is spaced from the dispenser wall 30, and a dosing space 49 is defined between the dispenser wall and applicator pad. Upon holding the cap 14 and shaking the bottle 12, product is delivered through the supply openings 32 into the dosing space 49 to redose the applicator pad 44. As noted above, the applicator pad is sized to contact the side wall 26 of the neck insert 24, so that the product does not leak past the applicator pad during this redosing. The supply openings are, of course, selected so that the product is adequately, but not excessively delivered to the applicator pad. In general, less viscous products can be initially dosed to an applicator pad adjacent the dispenser wall through relatively small supply openings, and the relatively small supply openings also work for redosing the pad when it is spaced from the dispenser wall as shown in FIG. 3. The low viscosity product readily passes through the supply openings to dose the pad 44, and also readily drains back to the product cavity.

The dosing amount of higher viscosity products is limited by the dosing space 49. Thus, an excessively large glob of product cannot be picked up by the applicator pad, and product also cannot accumulate on the sides of the applicator pad. The size of the dosing space may also be made appropriate to the product by selection of the dimensions of the stem 42 and/or neck insert 24.

Figure 5:
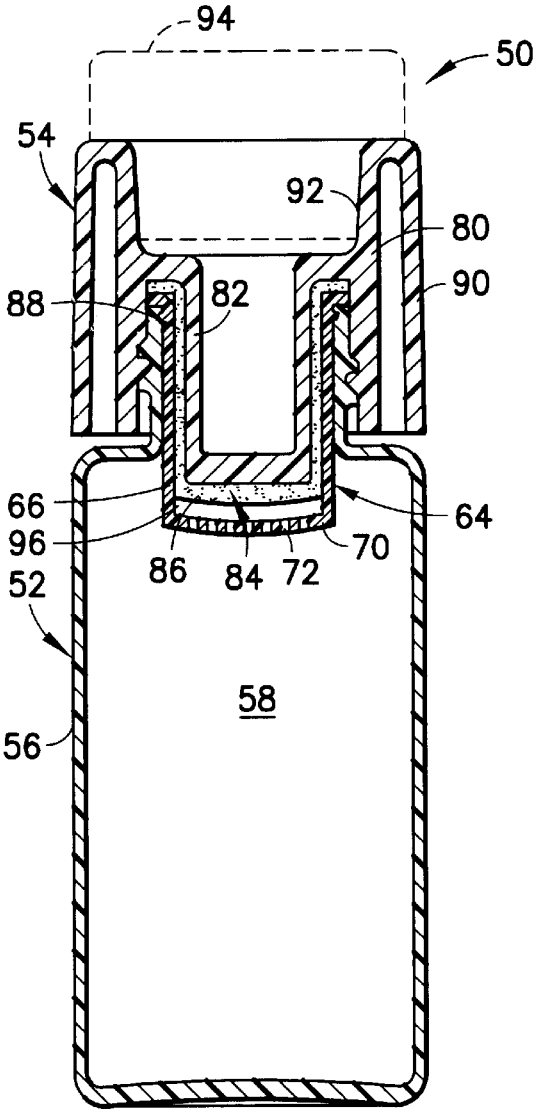
FIG. 5 is a longitudinal sectional view of another cosmetics container according to the invention herein.
Figure 6:
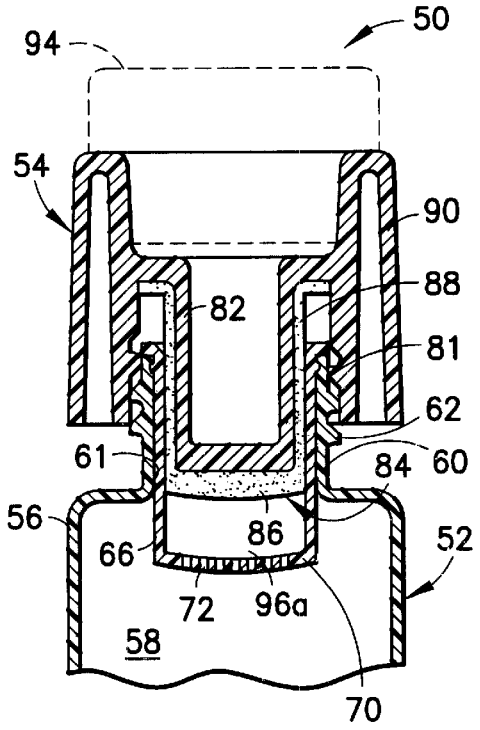
FIG. 6 is a longitudinal sectional view of the cosmetics container of FIG. 5, partially cut away, with the applicator cap inserted for receiving a dose of product.
Figure 7:
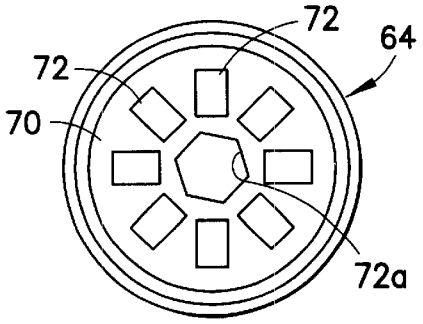
FIG. 7 is a top plan view of the neck insert of the cosmetics container of FIG. 5.
Figure 11:
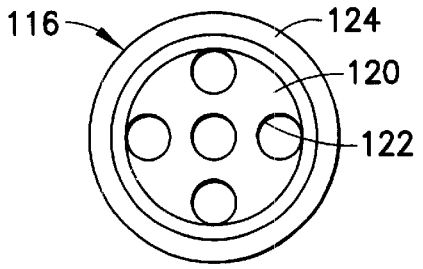
FIG. 11 is a top view of the neck insert of the cosmetics container of FIG. 8.

With reference to FIGS. 5–7, another cosmetics container 50 according to the invention herein is illustrated. The cosmetics container 50 has bottle 52 and applicator cap 54. The bottle 52 has a body 56 defining a product cavity 58. The bottle 52 includes a neck 60 with exterior threads 62 for engaging the cap 54, and the neck 60 also defines a neck opening 61 to the product cavity 58.

A neck insert 64 is mounted in the neck 60 and has a side wall 66 further defining the neck opening 61 and a dispenser wall 70. The dispenser wall 70 separates the neck opening 61 of the bottle from the product cavity 58, and defines supply openings 72 for delivering product. The supply openings 72 are in the form of rectangular slots, and a polygonal central opening 72a adds transfer capacity.

The applicator cap 54 includes a generally tubular handle 80 with threads 81 on its interior surface for screw engagement on the threads 62 of the neck 60. The cap 54 further includes a stem 82 which extends into the neck insert 64 when the applicator cap is on the bottle, and the stem 82 has an applicator pad 84 secured thereon at its distal end. The applicator pad includes a head portion 86 and a stem tubular side wall 88 that is fitted over the stem 82 and is deployed between the stem 82 and the side wall 66 of the neck insert when the applicator cap is on the bottle. The handle 80 is formed with an outer skirt 90 which provides thickness to the handle, and a finger space 92. These help the user to comfortably grip and manipulate the applicator cap 54. A plug 94, shown in phantom, is optionally provided to close the finger space or recess 92 between uses or to provide an alternative handle configuration during use.

With reference to FIG. 5, the head 86 of the applicator pad is spaced from the dispenser wall when the applicator cap is screwed onto the bottle to provide a dosing space 96. This dosing space 96 between the head 86 of applicator pad 84 and dispenser wall 70 allows a more viscous product to accumulate and dose the applicator pad when the cap is screwed to its closed position. When the applicator cap is removed and the dose of cosmetics present on the applicator pad has been utilized, the applicator cap 54 is returned to the bottle 52 as shown in FIG. 6, with the cap 54 supported on the threads 62 but not screwed thereon. This provides increased dosing space 96*a* between the applicator pad and the dispenser wall as compared to the position in FIG. 5; however, by proper sizing and configuration of the supply openings 72, the pad 86 may be redosed with a desired amount of product by shaking the bottle. The side wall 88 of the applicator pad engages with the interior of the neck insert during the redosing of the applicator pad 86, so that the product does not leak from the bottle 12.

Referring now to FIGS. 8-11, another cosmetics container 100 according to the invention generally comprises a bottle 102 and a cap 104. The bottle 102 has a body 106 that defines a product cavity 108. The body 106 transitions to a neck 110, which is provided with threads 112 on its exterior surface. Interiorly, the neck defines a neck opening 114 providing access to the product cavity 108.

A neck insert 116 has a tubular side wall 118 that fits in the neck opening 114. A dispenser wall 120 is provided at the product cavity end of the neck insert, with supply openings 122 permitting the product to exit the product cavity 108. A lip 124 at the upper end of the neck insert 116 fits over the distal end 126 of the neck 110, and supports and positions the neck insert 116 on the bottle 102.

The applicator cap 104 includes a molded head 128 having a tubular outer wall 130 received in an outer shell handle 132. The outer shell handle 132 may be provided with a pleasing exterior surface and a flat end panel 133 for printing product information, displaying product color, or the like. This structure also permits the use of different exterior finishes, dimensions, shapes, and the like, with a single molded head 128 providing utilitarian features of the cap 104.

The interior of the tubular outer wall 130 defines threads 134 for engaging the threads 112 of the neck. The threads cooperate for turning or screwing the cap to a lower, closed position shown in FIG. 10, and the threads 112 of the neck in the cap also cooperate to hold the cap in the position shown in FIGS. 8 and 9, spaced upwardly with respect to the bottle 102. In particular, the lowest thread portion 134*a* of the cap threads engages and rests on the highest thread portion 112*a* of the neck to support the cap spaced from the body.

The head 128 further defines a stem 136 concentric with the outer wall 130, and sized to fit within the neck insert 116. The stem 136 mounts an applicator pad 140 in a recess 138 at its distal end.

In the cosmetics container 100, the applicator pad 140 is fabricated of a compressible, open cell foam. It has a cylindrical side surface 142, which is of sufficient dimension to contact the inside surface of the neck insert in order to prevent passage of the product past the applicator pad during dosing of the pad. The stem can also be sized to provide this function, or an auxiliary seal may be provided on the stem to seal the stem to the opening.

Figure 8:
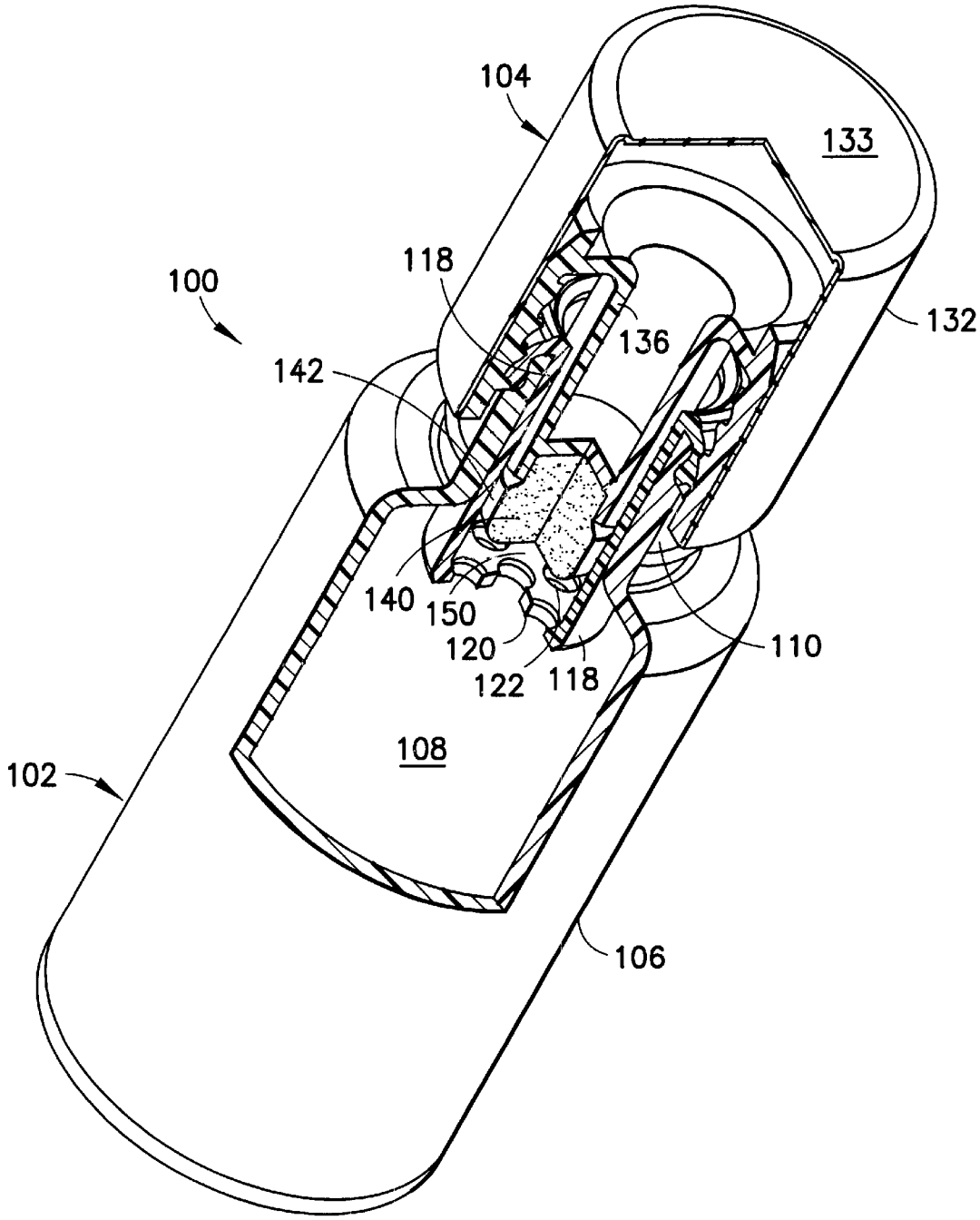
FIG. 8 is a perspective view, partially cut away, of another cosmetics container according to the invention herein, with its applicator cap spaced from its closed position.
Figure 9:
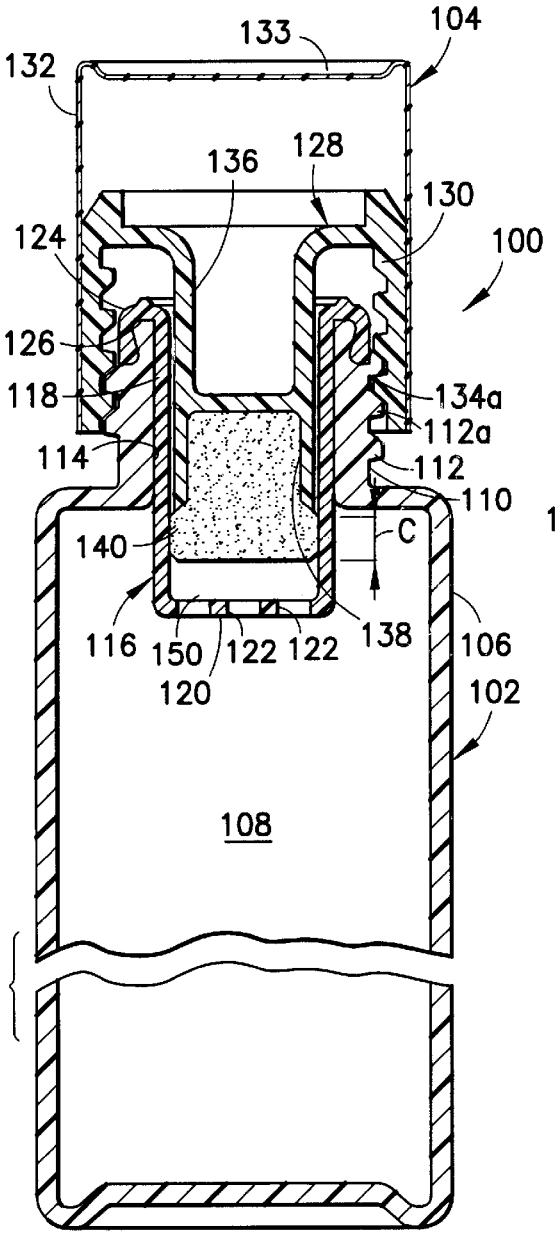
FIG. 9 is a longitudinal section view, of the cosmetics container of FIG. 8 with the applicator cap spaced from its closed position.

The applicator pad 140 has an uncompressed thickness T illustrated in FIG. 9, and the applicator pad is not compressed when the cap is supported on the neck spaced from the body as shown in FIGS. 8 and 9. The spacing is sufficient to provide a dosing space 150 between the dispenser wall 120 and the end surface 144 of the applicator pad 140.

It may be noted that the supply openings can be located radially with respect to the dosing space 150, i.e., it is only necessary that they open to a space that doses the pad. Openings in such a position are considered to be on the dispenser wall.

Figure 10:
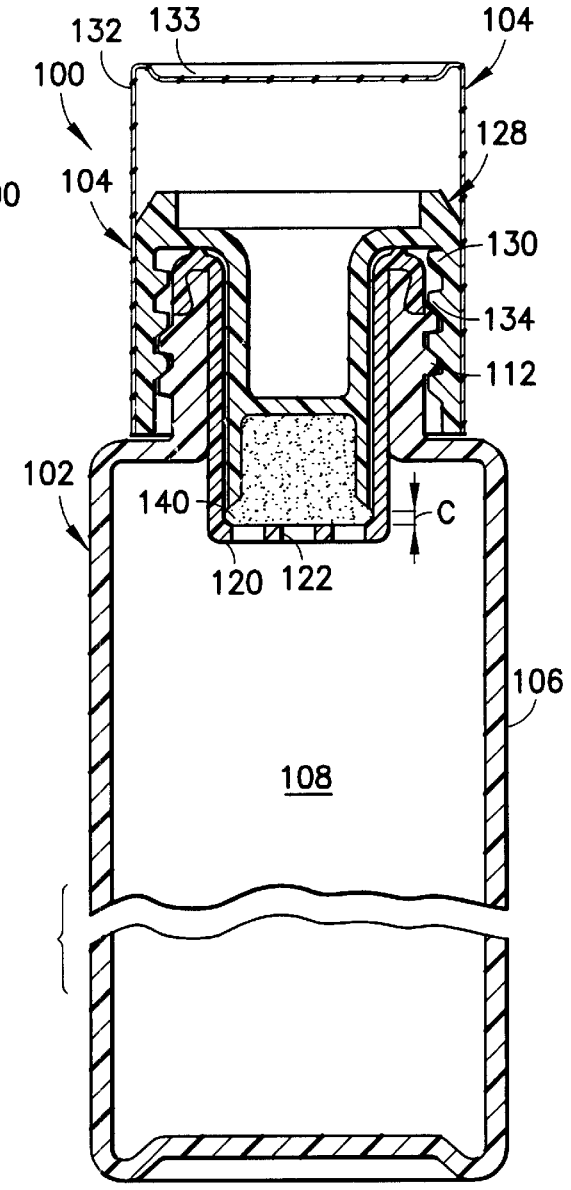
FIG. 10 is a longitudinal sectional view of the cosmetics container of FIG. 8 with the applicator cap screwed to its closed position.

When the cap is screwed on the bottle to its closed position, as shown in FIG. 10, the applicator pad 140 is compressed against the dispenser wall 120 to a thickness C. The compression is preferably sufficient that the applicator pad holds a minimal amount of product in its compressed condition, i.e., it is "wrung out."

The cosmetics container 100 is well adapted for use with viscous pigmented creams, such as concealers and blushers. It is difficult to store a foam pad in a container where it is exposed to viscous pigmented creams. In such a situation, the cream is generally present on the surface of the pad and penetrates the pad, and the cream can dry out unless the pad is immersed in the cream and thereby kept moist. It will be understood that the creams are often designed to dry out, leaving the pigment applied to the skin in a natural appearing manner. However, when the cream dries out on and in the foam pad, it also leaves an accumulation of pigment, which clogs the pad and makes it less effective for use in applying cream.

The cosmetics container 100 addresses this problem by compressing the applicator pad 140 when the cap 104 is twisted to its closed position, substantially removing excess cream from the applicator pad and limiting the ability of the pad to take up more cream from the product cavity 108. Also, the dispenser wall 120 with its supply openings 122 limits the amount of product that can contact the surface of the applicator pad 140, and tends to provide an accumulation of the product in the supply openings so that the product does not dry on the surface of the foam pad. This maintains the pad in good condition between uses of the cosmetics container 100, and that product is remixed when the container is shaken for the next use.

When the user desires to apply the product, the cap 104 is loosened to the position shown in FIG. 9, and the bottle is shaken. This causes the product to mix and to enter the dosing space 150, where it is absorbed by and deposited on the surface of the applicator pad 140. The cap 104 may then be removed from the bottle and manipulated to apply the product. For additional applications, the cap is replaced on the bottle 102 in the position shown in FIGS. 8 and 9, and the cap 104 and bottle 102 are shaken as a unit to apply an additional dose of product to the applicator pad. When the user has finished applying the product, the cap 104 is replaced and twisted to its closed position shown in FIG. 10, which compresses the applicator pad 140 to remove product therefrom until the next use of the container.

It will be noted that all of the cosmetics containers 10, 50 and 100 providing a dosing space relationship with the dispenser wall to control the amount of cosmetics applied to the pad before use. The control is achieved both by the size and distribution of the supply openings and also by the space between the dispenser wall and the applicator pad when the applicator cap is supported on the neck of the bottle, but not closed. Contact of the applicator pad with the dispenser wall and compression of the pad, if desired, when the caps of the containers 10, 50 and 100 are in their closed positions is also beneficial in the manner described above.

Accordingly, cosmetics containers have been described which admirably achieve the objects of the invention herein. It will be appreciated that various changes may be made from the preferred embodiments described above without departing from the spirit and scope of the invention, which is limited only by the following claims.

What is claimed is:

1. A cosmetics container for storing and applying a product comprising:

a bottle having a neck defining a cap engaging means and further defining a neck opening to a product cavity within the bottle;

a dispenser wall deployed between the neck opening and the product cavity, the dispenser wall defining at least one supply opening for delivering product from the product cavity;

a cap having neck engaging means for removably securing the cap on the cap engaging means of the neck of the bottle, the cap having a stem extending into the neck and an applicator pad mounted to a distal end of the stem, the cap engaging means of the neck and the neck engaging means of the cap configured to support the cap, when placed on but spaced from its closed position on the neck, with the applicator pad positioned with respect to the dispenser wall for receiving a dose of the product through the at least one supply openings in the dispenser wall, the at least one supply opening being sized and adapted to deliver product from the product cavity when the cap is supported but spaced from its closed position on the neck.

2. The cosmetics container as defined in claim 1, wherein the cap engaging means and neck engaging means support the cap, when placed on but spaced from its closed position on the neck, with the applicator pad spaced from the dispenser wall to define a dosing space therebetween.

3. The cosmetics container as defined in claim 2, wherein one of the applicator pad and stem seals to the neck opening to prevent egress of product from the neck opening during dosing of the applicator pad.

4. The cosmetics container as defined in claim 3, wherein the applicator pad seals to the neck opening.

5. The cosmetics container as defined in claim 3, wherein the dispenser wall is provided on a distal end of a neck insert mounted in and further defining the neck opening, and the stem and applicator pad are received in the neck insert.

6. The cosmetics container as defined in claim 2, wherein the applicator pad is fabricated of a compressible foam.

7. The cosmetics container as defined in claim 6, wherein the applicator pad is compressed when the cap is secured in its closed position on the bottle.

8. The cosmetics container as defined in claim 7, wherein the cap engaging means of the neck are exterior threads thereon, the neck engaging means of the cap are interior threads formed therein, and the threads of the cap rest on the threads of the neck when the cap is placed on but spaced from its closed position to support the cap with the applicator pad spaced from the dispenser wall, and the threads of the cap and neck threads interengage as the cap is turned to its closed position securing the cap on the bottle.

9. The cosmetics container as defined in claim 2, wherein the cap engaging means of the neck are exterior threads thereon, the neck engaging means of the cap are interior threads formed therein, and the threads of the cap rest on the threads of the neck when the cap is placed on but spaced from its closed position to support the cap with the applicator pad spaced from the dispenser wall, and the threads of the cap and neck threads interengage as the cap is turned to its closed position securing the cap on the bottle.

10. The cosmetics container as defined in claim 1, wherein the cap engaging means of the neck are exterior threads thereon, the neck engaging means of the cap are interior threads formed therein, and the threads of the cap rest on the threads of the neck when the cap is placed on but spaced from its closed position to support the cap with the applicator pad spaced from the dispenser wall, and the threads of the cap and neck threads interengage as the cap is turned to its closed position securing the cap on the bottle.

11. The cosmetics container as defined in claim 10, wherein the applicator pad is fabricated of a compressible foam and is compressed when the cap is secured in its closed position on the bottle.

12. A cosmetics container as defined in claim 1, wherein the cap defines a finger space above the stem and applicator pad, for receiving the user's finger while manipulating the cap and the applicator pad.

13. The cosmetics container as defined in claim 1, wherein one of the applicator pad and stem seals to the neck opening to prevent egress of product from the neck opening during dosing of the applicator pad.

14. The cosmetics container as defined in claim 13, wherein the applicator pad seals to the neck opening.

15. The cosmetics container as defined in claim 1, wherein the dispenser wall is provided on a distal end of a neck insert mounted in and further defining the neck opening, and the stem and applicator pad are received in the neck insert.

16. The cosmetics container as defined in claim 1, wherein the applicator pad is fabricated of a compressible foam.

17. The cosmetics container as defined in claim 16, wherein the applicator pad is compressed when the cap is secured in its closed position on the bottle.

18. The cosmetics container as defined in claim 1 and further comprising a pigmented cosmetics cream product contained in the product cavity.

19. A cosmetics container for storing and applying a product, comprising:

a bottle having a neck defining a neck opening to an interior product cavity of the bottle, the neck having threads on the exterior thereof;

a neck insert mounted in the neck opening, the neck insert including a side wall substantially conforming to the neck opening, wherein the neck insert provides access to the product cavity by further defining the neck opening, the neck insert including a dispenser wall deployed between the neck opening and product cavity, the dispenser wall defining at least one supply opening;

a cap having interior threads for removably securing the cap on the bottle in a closed position by interengaging the threads on the neck, the cap having a stem extending into the neck insert and an applicator pad mounted to a distal end of the stem, the threads of the neck and the threads of the cap configured to support the cap on the neck prior to threaded engagement of the threads to a closed position with the applicator pad spaced from the dispenser wall to define a dosing space therebetween, the at least one supply opening being sized and adapted to deliver the product to the dosing space defined between the applicator pad and when the cap is supported on the mole but spaced from its closed position the dispenser wall;

wherein the applicator pad is fabricated of compressed foam and is compressed against the dispenser wall when the cap is threaded to its closed position on the bottle, and the applicator pad substantially seals to the neck insert above the at least one supply opening to prevent egress of product during dosing of the applicator pad.

20. The cosmetics container as defined in claim 19 and further comprising a pigmented cosmetics cream product contained in the product cavity.

* * * * *